US008106849B2

(12) United States Patent
Reavis et al.

(10) Patent No.: US 8,106,849 B2
(45) Date of Patent: Jan. 31, 2012

(54) PLANAR ANTENNA ARRAY AND ARTICLE OF MANUFACTURE USING SAME

(75) Inventors: Kathryn Reavis, San Diego, CA (US); Ralph Suddath, Hickory Creek, TX (US); Don Vance, Denton, TX (US)

(73) Assignee: SVR Inventions, Inc., Carson City, NV (US)

( * ) Notice: Subject to any disclaimer, the term of this patent is extended or adjusted under 35 U.S.C. 154(b) by 385 days.

(21) Appl. No.: 12/550,215

(22) Filed: Aug. 28, 2009

(65) Prior Publication Data

US 2011/0050520 A1 Mar. 3, 2011

(51) Int. Cl.
*H01Q 1/36* (2006.01)

(52) U.S. Cl. ..... 343/895; 343/700 MS

(58) Field of Classification Search ..... 343/895, 343/700 MS; 340/572.7
See application file for complete search history.

(56) References Cited

U.S. PATENT DOCUMENTS

| | | | | |
|---|---|---|---|---|
| 5,146,234 | A * | 9/1992 | Lalezari | 343/895 |
| 6,466,177 | B1 * | 10/2002 | Kunysz | 343/769 |
| 6,963,317 | B2 * | 11/2005 | Zuk et al. | 343/895 |
| 7,692,546 | B2 * | 4/2010 | Camp et al. | 340/572.7 |
| 2008/0058583 | A1 | 3/2008 | Mohan | |

OTHER PUBLICATIONS

International Search Report, PCT/US2010/046154, Oct. 18, 2010.

* cited by examiner

*Primary Examiner* — Hoang V Nguyen
(74) *Attorney, Agent, or Firm* — Scott T. Griggs; Griggs Bergen LLP

(57) ABSTRACT

A planar antenna array and articles of manufacture using the same are disclosed. In one embodiment, close-packed antenna elements, disposed on a substrate, number N where N=3x and x is a positive integer. Each of the close-packed antenna elements includes a substantially continuous photonic transducer arranged as an outwardly expanding generally logarithmic spiral having six turns. Each of the outwardly expanding generally logarithmic spirals may be a golden spiral. As an article of manufacture, the planar antenna array may be incorporated into a chip, such as a cell phone, or an article of clothing, for example.

20 Claims, 4 Drawing Sheets

PLANAR ANTENNA ARRAY AND ARTICLE OF MANUFACTURE USING SAME

TECHNICAL FIELD OF THE INVENTION

This invention relates, in general, to antenna arrays of radiating and receiving elements and, in particular, to planar arrays of radiating and receiving elements including spiral lattices and articles of manufacture using the same.

BACKGROUND OF THE INVENTION

Without limiting the scope of the present invention, its background will be described with reference to electromagnetic field (EMF) radiation interacting with humans, as an example. The negative effects of high intensity EMF radiation on humans have been proved conclusively. High intensity EMF radiation damages basic cell structure and DNA. With respect to low intensity EMF radiation, it is now acknowledged that EMF radiation influences the environment. The degree to which short-term and long-term exposure to low intensity EMF radiation impacts humans is now an area of ongoing study and intense debate with credible evidence mounting that demonstrates the degree to which short-term and long-term exposure negatively impact the human body.

SUMMARY OF THE INVENTION

A planar antenna array and articles of manufacture using the same are disclosed that mitigate the harmful effects of low-intensity EMF radiation on humans. Additionally, in particular embodiments improved balance, flexibility, energy, strength, recovery, immunity, and/or relaxation are imparted as is a decrease in stress. That is, the impact of psychological factors on many health aspects and performance cannot be ignored and the planar antenna array and articles of manufacture presented herein ameliorate real and psychological factors giving rise to physiological conditions as well as psychosomatic symptoms and somatoform-related disorders.

In one embodiment, close-packed antenna elements are disposed on a substrate and number N where N=1 or 3x, x being a positive integer. Each of the close-packed antenna elements includes a substantially continuous photonic transducer arranged as an outwardly expanding generally logarithmic spiral having six turns. Each of the outwardly expanding generally logarithmic spirals may be a golden spiral. As an article of manufacture, the planar antenna array may be incorporated into a chip, such as a cell phone, or an article of clothing or jewelry, for example.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
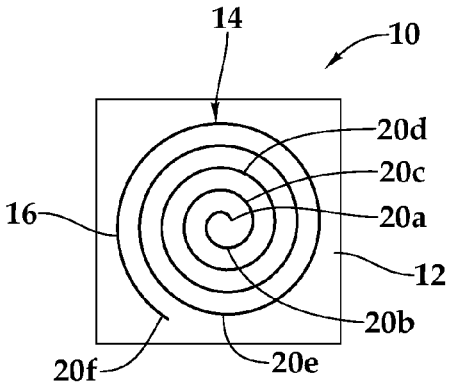
FIG. 1A is a top plan view of one embodiment of a planar antenna array.

Referring initially to FIG. 1A, therein is depicted a planar antenna array that is schematically illustrated and generally designated 10. The planar antenna array 10 includes a substrate 12 having an antenna element 14 disposed thereon, which includes a substantially continuous photonic transducer 16 arranged as an outwardly expanding generally logarithmic spiral 18 or spiral lattice having six turns 20A, 20B, 20C, 20D, 20E, 20F. The photonic transducer 16 may be a clockwise or counterclockwise spiral and, as discussed below, have any type of phasing.

In one embodiment, the outwardly expanding generally logarithmic spiral 18 is a golden spiral which is described according to the following polar equation:

$$r=ae^{b\theta} \text{ or } \theta=(1/b)\ ln\ (r/a),$$

with e being the base of natural logarithms, a being an arbitrary positive real constant, and b a number relative to the relationship that when θ is a turn, direction b satisfies the equation $e^{b\theta right/left}=\phi$ As will be appreciated, the numerical value of b depends on whether the angle is measured as in terms of degrees, i.e., 90 degrees, or in terms of radians, i.e., π/2 radians; and as the angle may be in either direction, e.g., clockwise or counterclockwise, it may be formulated as an absolute value as follows:

$$|b|=(\ln \phi)/90 =0.0053468 \text{ for } \theta \text{ in degrees;}$$

$$|b|=(\ln \phi)/(\pi/2)=0.306349 \text{ for } \theta \text{ in radians.}$$

Such a golden spiral is based upon the golden ratio, which is a fundamental ratio found over and over again in nature. Geometrically, it can be defined as the ratio obtained if a line is dived so that the length of the shorter segment is in the same proportion to that of the longer segment as the length of the longer segment is to the entire line. Mathematically, those ratios represent an irrational number of approximately 1.618054.

Figure 1B:
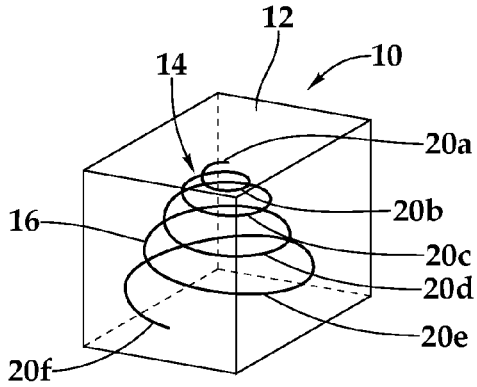
FIG. 1B is a perspective view of the planar antenna array of FIG. 1A in a three-dimensional implementation.

The substrate 12 may comprise a material selected from the group consisting of cellulose pulps, metals, textiles, fabrics, polymers, ceramics, organic fibers, silicon, and composites, for example. In particular, the substrate may include a portion of an article of clothing or garment. The photonic transducer 16 may be a material selected from the group consisting of inks, incisable materials, and resins. Moreover, the photonic transducer 16 may be a material that radiates and receives light protons or a photorefractive material. In one implementation, the photonic transducer 16 includes non-local, non-Hertzian properties that organize and restore, i.e., provide quantum coherence to, disrupted photonic fields of light that naturally occur. It should be appreciated, however, that the planar antenna array 10 is not limited to embodiments substantially on a plane. FIG. 1B illustrates a three-dimensional analog of the planar antenna array 10 that is within the teachings of the present invention also. The photonic transducer 16 may be disposed on the substrate 12 by any number of processes including imbedding, burnishing, imprinting, photographic development (using, for example, laser, led or uv), silk screen technologies, electro-photography techniques, tonal graphic techniques, thermal techniques, holographic-based transfer techniques, ink-based techniques, electro-sublimation transfer, block printing techniques, lithographic techniques, photolithic imprinting, negative photographic printing techniques, piezoelectric printing, electrostatic printing, and thermal transfer, for example.

Figure 2:
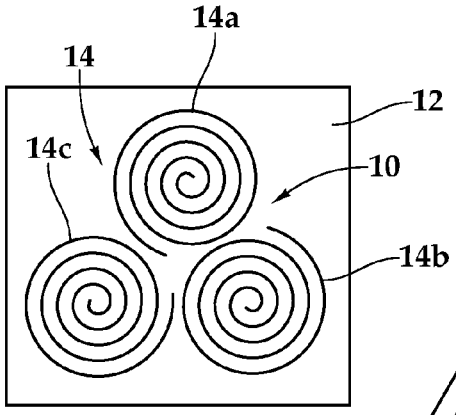
FIG. 2 is a top plan view of another embodiment of a planar antenna array.
Figure 3A:
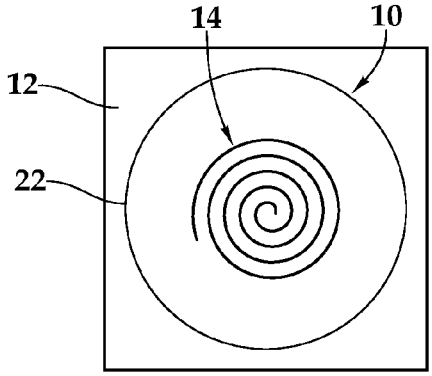
FIGS. 3A and 3B are top plan views of further embodiments of planar antenna arrays.
Figure 3B:
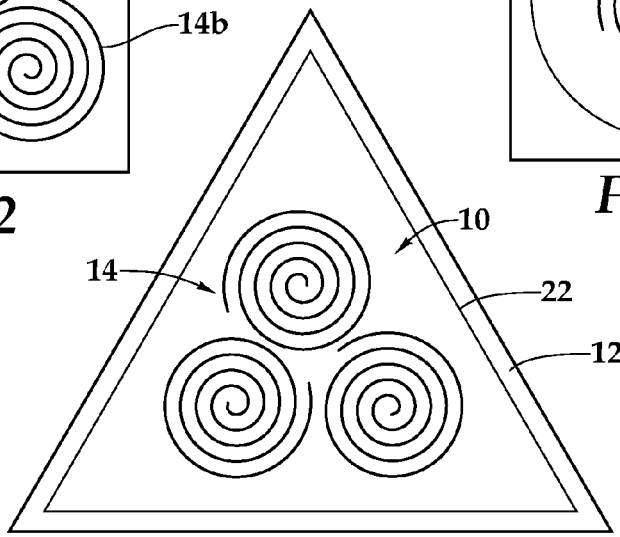
Figure 4:
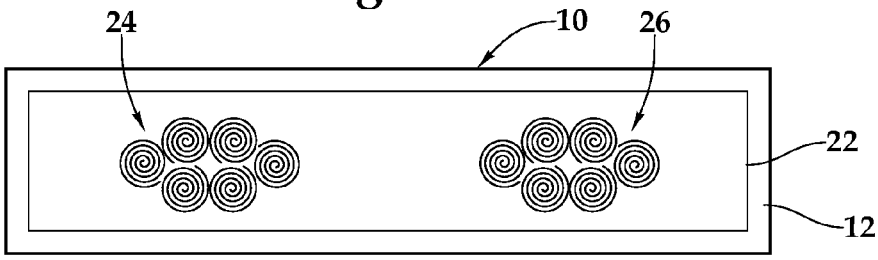
FIG. 4 is a top plan view of a still further embodiment of a planar antenna array.
Figure 3C:
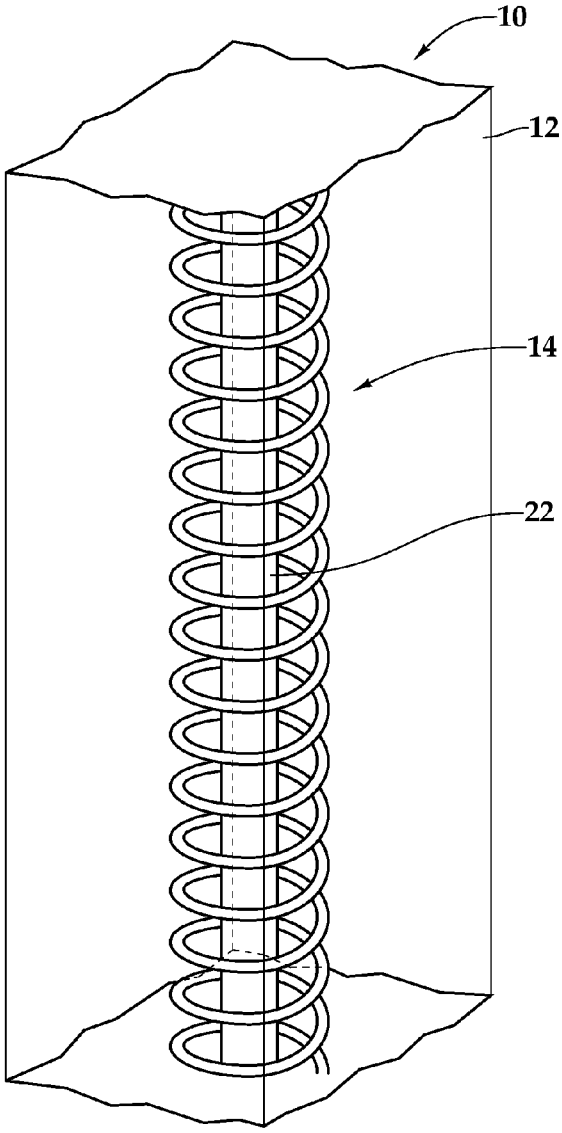
FIG. 3C is a perspective view of a further embodiment of a planar antenna array.

FIG. 2 depicts another embodiment of the planar antenna array 10. As shown, close-packed antenna elements, collectively 14 and individually 14A, 14B, 14C, numbering N where N=3x, x being a positive integer, are depicted. In conjunction with FIG. 1, it should be understood that the number of antenna elements may number 1, 3, 6, 9, 12, 15, 18, etc. Moreover, the antenna elements 14 may be phased, for example, such that the antenna elements 14 are respectively positioned at 120°, 240°, and 360°. Other variations are within the teachings of the present invention. For example, with reference to FIGS. 3A and 3B, further embodiments of the planar antenna array 10 are depicted wherein a substantially continuous photonic transducing barrier 22 bounds the close-packed antenna elements 14 to establish photonic coupling therebetween. As shown in FIG. 3A, the substantially continuous photonic transducing barrier 22 may be a circle or other geometric shape including the triangle presentation of FIG. 3B. FIG. 3C illustrates a three-dimensional analog, which may be even a hologram or holographic embodiment, of the use of geometric shapes wherein the antenna element 14 is a spiral helix around disposed about a cylindrical photonic transducing barrier 22. By way of further explanation, the spiral of the antenna element 14 of FIG. 3C includes a number of turns equal to 6, 9, or y, where y is a positive integer greater than 9. The substantially continuous photonic transducing barrier may have a construction, materials, and placement (on the substrate) analogous to that of the antenna elements 14 and photonic transducer 16. By way of further example, FIG. 4 shows an embodiment of a planar antenna array wherein two groupings 24, 26 of six close-packed antenna elements each are disposed on the substrate 12. As depicted, the close-packed antenna elements 14 include a 1-4-1 close-packing arrangement. It should be appreciated, however, that other packing arrangements are within the teachings presented herein.

Figure 5:
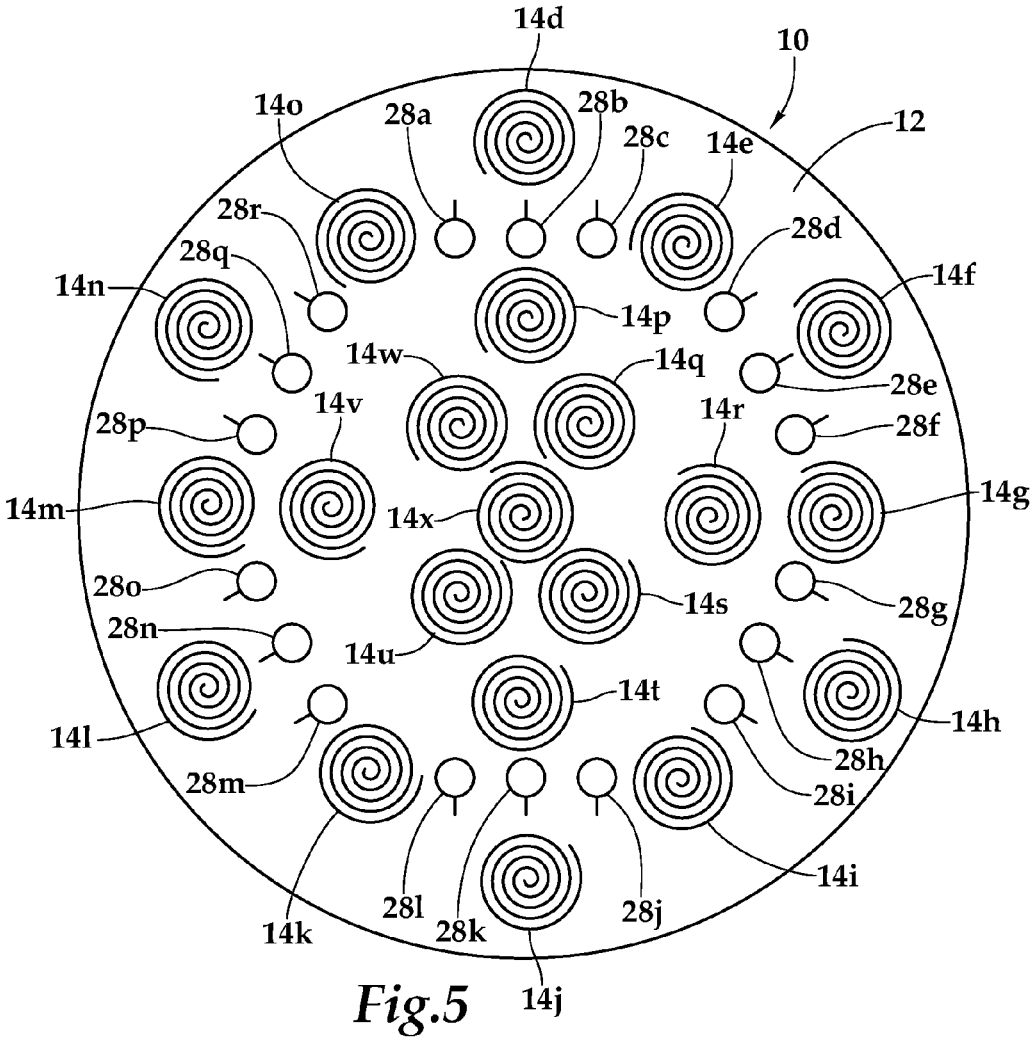
FIG. 5 is a top plan view of a still further embodiment of a planar antenna array.

FIG. 5 depicts one embodiment of the planar antenna array 10 including antenna elements 14 and, in particular, antenna elements 14D through 14X arranged in groupings of 1 or 3x, where x is a positive integer. For example, antenna elements 14D and 14J are singletons or groupings of one. On the other hand, antenna elements 14P through 14X are located in a grouping of 9 or 3x, where x is the integer 3. Disposed between the various groupings of antenna elements 14, are groupings of geometrically circular objects, collectively 28, and individually 28A through 28R. These geometrically circular objects 28 are shown as circles having lines extending therefrom. The construction, materials, and placement (on the substrate) of these geometrically circular objects 28 may be similar to that of the antenna elements 14 and photonic transducers 16. These geometrically circular objects are grouped in groupings of 3x, where x is an integer. For example, geometrically circular objects 28D through 28F are grouped in a grouping of three between boundaries approximated by antenna elements 14E, 14F, 14Q, and 14R.

In FIGS. 1A through 5, therein are depicted a number of non-limiting embodiments of the planar antenna array 10. By way of brief summary, in spirology or the study of the illustrated arrangements of spiral antenna arrays, the antenna array may include antenna elements in geometrical close-packed groupings of 1 or 3x, where x is an integer. These antenna elements may be located in a planar array or three-dimensional or holographic analog thereof. The singleton or close-packed groupings of antenna elements may be bounded by a substantially continuous photonic transducing barrier. Moreover, geometrically circular objects may be grouped in groupings of 3x, where x is an integer, between the singleton or close-packed groupings of antenna elements. As discussed, in one implementation, the antenna elements include spirals or golden spirals having 3x turns where x is an integer greater than 1. In another embodiment, the spiral includes a number of turns equal to 6, 9, or y, where y is a positive integer greater than 9.

Figure 6:
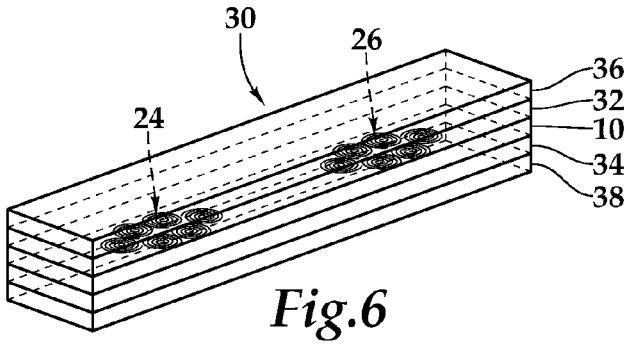
FIG. 6 is a side cross-sectional view of one embodiment of the planar antenna array being utilized as a chip.

FIG. 6 illustrates one embodiment of the planar antenna array 10 being utilized as a chip 30. In this arrangement, the planar antenna array 10 is embedded in a multiple layered or strata application having the form of the chip 30, which dimensions will be depend on the application. Protective polycarbonate polymer layers 32, 34 are affixed or bonded above and below the planar antenna array 10. A foil layer 36 is superposed to the protective polycarbonate polymer layer 32 to show a brand and other information. A base layer 38 is located beneath the protective polycarbonate layer 34.

Figure 7:
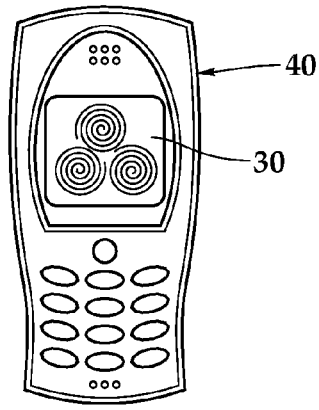
FIG. 7 is a front perspective view of one embodiment of the chip of FIG. 6 being used with a cellular telephone.
Figure 8:
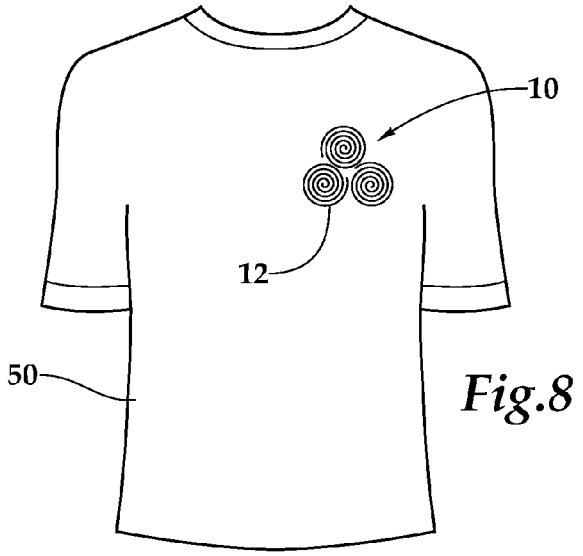
FIG. 8 is a front elevation view of one embodiment of the planar antenna array being embedded within an article of clothing.

FIG. 7 is a front perspective view of one embodiment of the chip 30 of FIG. 6 being used with a cellular telephone 40. The chip 30 may be embedded in the cellular telephone 40 or associated therewith on the outside as shown. Another application of the planar antenna array is depicted in FIG. 8 wherein the planar antenna array 10 is embedded within an article of clothing 50 wherein the clothing may form the substrate 12 with the antenna elements 14 disposed thereon. In such embodiments, the antenna elements 12 may be woven, in a dimensional or three-dimensional presentation, into the substrate 12 or garment. It should be understood that the planar antenna array 10 is not limited to any particular chip or article of clothing or garment. By way of example and not by way of limitation, the planar antenna array 10 may be incorporated into a bracelet, anklet, pocket chip, automotive chip, under garment, shoe insert, sock, glove, pants, vest, jacket, wrist band, watch, pillow, sheets, coffee cup, glass, label, storage container, or other item of manufacture. Moreover, these articles of manufacture in which the planar antenna array 10 may be associated with are not limited to those typically used by humans. Items and articles of manufacture used by animals or pets, such as bowels, harnesses, sweaters, collars, blankets, feeding and drinking troughs, may also include the planar antenna array 10.

Figure 9A:
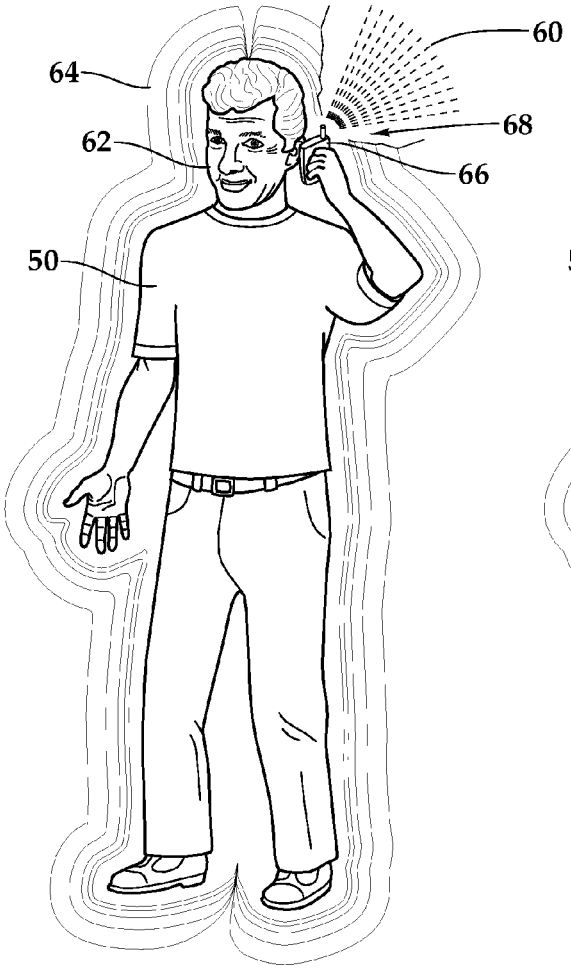
FIGS. 9A and 9B are schematic views of one embodiment of the planar antenna array mitigating low-intensity EMF radiation on humans.
Figure 9B:
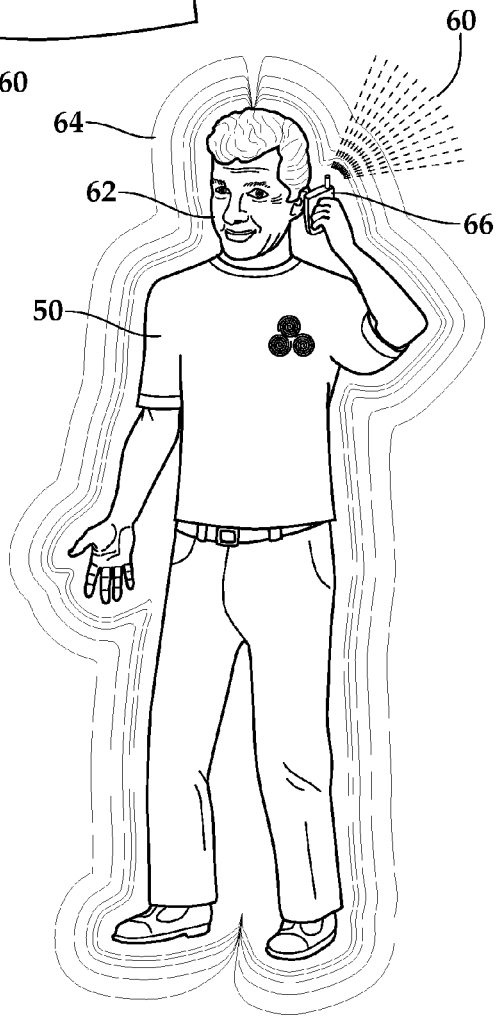

FIGS. 9A and 9B are schematic views of one embodiment of the planar antenna array 10 mitigating low-intensity EMF radiation 60 on a human or individual 62 having an EMF field 64 therearound, which may be referred to as biofield. In FIG. 9A, the biofield 64 of the individual is negatively impacted by EMF radiation 60 from a source 66, which is depicted as a cellular telephone. It should be appreciated, however, that the source may comprise any object or device, natural or man made, that emits EMF radiation. This negative impact may take one of many forms including inflammation in the body, decreased cellular oxygenation, reduced stamina and endurance, agitated nervous system, muscle tension, spasms, cramping, headaches and migraine pains, or decreased digestive function, for example. As depicted, the negative impact is shown by number 68.

As shown in FIG. 9B, the planar antenna array 10 is associated with the individual 62 as being embedded or integrated into an article of clothing 68. In one implementation, the photorefractive or other photonic materials that form the antenna elements 14 exhibit photoconductive and electro-optic behavior, and have the ability to detect and store spatial distributions of optical intensity from EMF radiation in the form of spatial patterns of altered refractive index. Such photoinduced charges create a space-charge distribution that produces an internal electric field, which, in turns mitigates the negative effects of any low-intensity EMF radiation as shown by the healthy biofield 64. As previously alluded, however, the applications of the planar antenna array 10 are not limited to mitigating the negative effects of EMF radiation. Additionally, in particular embodiments improved balance, flexibility, energy, strength, recovery, immunity, and/or relaxation are imparted as is a decrease in stress.

Figure 10A:
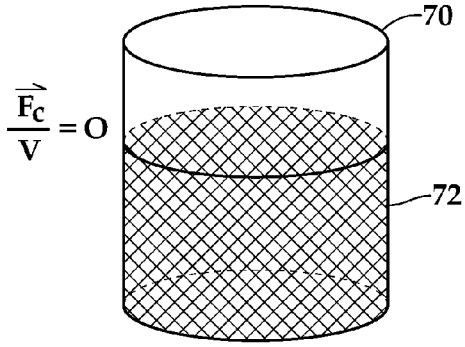
FIGS. 10A and 10B are schematic views of one embodiment of the planar antenna array affecting the photonic properties of an object.
Figure 10B:
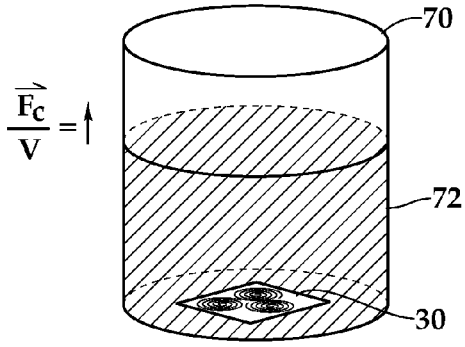

FIGS. 10A and 10B are schematic views of one embodiment of the planar antenna array 10 incorporated into the chip embodiment 30 affecting the photonic properties of an object. In FIG. 10A, a glass 70 contains a liquid such as water 72. The force, $F_c$, for a volume, V, may be the electric component of the electromagnetic field and polarization and the magnetic components associated with the water 72. In the absence of an applied photonic or field causing a Casimir effect ($\vec{F}_c/V=0$), the force axes of the water have no preferred state, so that incident forces essentially encounter a mismatch.

As shown in FIG. 10B, the chip 30 is associated with the glass 70 by being placed therebeneath. Alternatively, the chip 30 may be incorporated into a drink holder or drink wrap or label and thereby associated with the glass 70. Over a time, t, due to photonic and electromagnetic interactions with between the chip 30 and surrounding environment, the chip 30 imparts an applied force ($F_c$) per volume, V, to the water 72 creating an aligned state that may affect one or more physical properties related to the photonics and electromagnetics of the water 72. Through a derivative effect, the water 72 may then be said to "be charged" and similarly impart the applied force to other objects. In one implementation, where the force may be expressed as sums over the energies of standing waves, which may be formally understood as sums over the eigenvalues of a Hamiltonian, the force, $F_c$, causes atomic and molecular effects, such van der Waals force-related effects, that may cause state changes in the water 72. If one considers the Hamiltonian of a system as a function of the arrangement of objects, such as atoms, in configuration space, then the zero-point energy of the water 72 as a function of changes of the configuration can be understood as a result of the applied force, $F_c$. It should be appreciated that the applied force and resulting state changes described in FIGS. 10A and 10B are not limited to water; water is presenting as a non-limiting example.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A planar antenna array comprising:

a substrate; and a plurality of close-packed antenna elements numbering N where N is selected from the group consisting of 1 and 3x, x being a positive integer, the plurality of close-packed antenna elements being disposed on the substrate, each of the plurality of close-packed antenna elements including a substantially continuous photonic transducer arranged as an outwardly expanding generally logarithmic spiral having six turns, wherein each of the outwardly expanding generally logarithmic spirals is described according to the following polar equation:

$$r=ae^{b\theta}$$

with e being the base of natural logarithms, a being an arbitrary positive real constant, and b a number relative to the relationship that when θ is a turn, direction b satisfies the equation $e^{b\theta right/left}=\phi$.

2. The planar antenna array as recited in claim 1, wherein each of the outwardly expanding generally logarithmic spirals comprises a golden spiral.

3. The planar antenna array as recited in claim 1, wherein at least one of the outwardly expanding generally logarithmic spirals comprises a counterclockwise spiral.

4. The planar antenna array as recited in claim 1, wherein at least one of the outwardly expanding generally logarithmic spirals comprises a clockwise spiral.

5. The planar antenna array as recited in claim 1, a further comprising a substantially continuous photonic transducing barrier which bounds the plurality of close-packed antenna elements.

6. The antenna array as recited in claim 1, wherein the substrate comprises a material selected from the group consisting of cellulose pulps, metals, textiles, fabrics, polymers, ceramics, organic fibers, silicon, and composites.

7. The antenna array as recited in claim 1, wherein the substrate comprises a portion of an article of clothing.

8. The antenna array as recited in claim 1, wherein the photonic transducer comprises a material selected from the group consisting of inks, incisable materials, and resins.

9. The antenna array as recited in claim 1, wherein the photonic transducer comprises a material which radiates and receives light photons.

10. The antenna array as recited in claim 1, wherein the photonic transducer comprises a phorefractive material.

11. An article of manufacture comprising:

a substrate;

a first layer superposed on the substrate and affixed thereto;

a second layer disposed beneath the substrate and affixed thereto; and a plurality of close-packed antenna elements numbering N where N is selected from the group consisting of 1 and 3x, x being a positive integer, the plurality of close-packed antenna elements being disposed on the substrate, each of the plurality of close-packed antenna elements including a substantially continuous photonic transducer arranged as an outwardly expanding generally logarithmic spiral having six turns, wherein each of the outwardly expanding generally logarithmic spirals is described according to the following polar equation:

$$r=ae^{b\theta}$$

with e being the base of natural logarithms, a being an arbitrary positive real constant, and b a number relative to the relationship that when θ is a turn, direction b satisfies the equation $e^{b\theta_{right/left}}=\phi$.

12. The article of manufacture as recited in claim 11 wherein the first layer comprises a protective polycarbonate polymer.

13. The article of manufacture as recited in claim 11 wherein the second layer comprises a protective polycarbonate polymer.

14. The article of manufacture as recited in claim 11, wherein each of the outwardly expanding generally logarithmic spirals comprises a golden spiral.

15. A planar antenna array comprising:

a substrate; and a first grouping of six close-packed antenna elements, the first grouping of close-packed antenna elements being disposed on the substrate, each of the six close-packed antenna elements including a substantially continuous photonic transducer arranged as an outwardly expanding generally logarithmic spiral having six turns;

a second grouping of six close-packed antenna elements disposed adjacent to the first grouping, the second grouping of close-packed antenna elements being disposed on the substrate, each of the six close-packed antenna elements including a substantially continuous photonic transducer arranged as an outwardly expanding generally logarithmic spiral having six turns, wherein each of the outwardly expanding generally logarithmic spirals of the first and second groupings is described according to the following polar equation:

$$r=ae^{b\theta}$$

with e being the base of natural logarithms, a being an arbitrary positive real constant, and b a number relative to the relationship that when θ is a turn, direction b satisfies the equation $e^{b\theta_{right/left}}=\phi$.

16. The planar antenna array as recited in claim 15, wherein the first grouping of six close-packed antenna elements comprise a 1-4-1 close-packing arrangement.

17. The planar antenna array as recited in claim 15, wherein the second grouping of six close-packed antenna elements comprise a 1-4-1 close-packing arrangement.

18. The planar antenna array as recited in claim 15, wherein the substrate is incorporated into an article of clothing.

19. The planar antenna array as recited in claim 15, wherein the substrate is incorporated into a chip.

20. The planar antenna array as recited in claim 15, wherein the substrate is incorporated into a bracelet.

* * * * *